US006945863B1

(12) United States Patent
Hettes

(10) Patent No.: US 6,945,863 B1
(45) Date of Patent: Sep. 20, 2005

(54) ROTARY FINISHING DISC

(75) Inventor: Frank J. Hettes, Greentown, PA (US)

(73) Assignee: Weiler Corporation, Cresco, PA (US)

( * ) Notice: Subject to any disclaimer, the term of this patent is extended or adjusted under 35 U.S.C. 154(b) by 0 days.

(21) Appl. No.: 10/921,602

(22) Filed: Aug. 19, 2004

(51) Int. Cl.[7] ..... B24D 17/00
(52) U.S. Cl. ..... 451/490; 451/510; 451/514; 451/515; 451/520; 451/521; 451/522
(58) Field of Search ..... 451/490, 510, 451/514, 515, 520, 521, 522

(56) References Cited

U.S. PATENT DOCUMENTS

| | | | | |
|---|---|---|---|---|
| 3,596,415 | A * | 8/1971 | Donahue, Jr. | 451/510 |
| 3,800,483 | A | 4/1974 | Sherman | |
| 3,879,178 | A | 4/1975 | Bosma | |
| 4,015,371 | A | 4/1977 | Grayston | |
| 4,088,729 | A | 5/1978 | Sherman | |
| 4,240,230 | A | 12/1980 | Ferrantini | |
| 4,541,205 | A | 9/1985 | Patrello | |
| 4,694,615 | A | 9/1987 | MacKay, Jr. | |
| 4,754,577 | A | 7/1988 | MacKay, Jr. | |
| 4,774,739 | A | 10/1988 | Sherman, Jr. | |
| 4,924,634 | A | 5/1990 | MacKay, Jr. | |
| 5,349,786 | A | 9/1994 | Dorrah | |
| 5,538,464 | A | 7/1996 | MacKay, Jr. | |
| 5,895,317 | A | 4/1999 | Timm | |
| 6,095,910 | A | 8/2000 | Luedeke | |
| 6,863,596 | B2 * | 3/2005 | Fritz et al. | 451/59 |

* cited by examiner

*Primary Examiner*—Joseph J. Hail, III
*Assistant Examiner*—Shantese McDonald
(74) *Attorney, Agent, or Firm*—Drinker Biddle & Reath LLP

(57) ABSTRACT

A flap disc includes a backing disc having an inner radial portion and abrasive flaps secured to an outer radial portion of the backing disc in an overlapping manner. First and second metal reinforcement rings include a body contacting one of front and rear surfaces of the backing disc adjacent a central opening. A threaded nut includes a body having an outer surface defining a shoulder and a retainer connected to the body. The shoulder contacts the second ring adjacent the central opening of the backing disc. The retainer is rolled outwardly to contact the first ring such that the nut and the rings are secured to the backing disc.

18 Claims, 3 Drawing Sheets

ROTARY FINISHING DISC

FIELD OF THE INVENTION

The present invention relates to surface finishing apparatuses and, more particularly, to a finishing disc for a rotatably driven tool.

BACKGROUND OF THE INVENTION

Known apparatuses for finishing surfaces include rotary finishing tools that rotatingly drive a disc assembly. The disc assembly includes a disc presenting an abrasive material for contacting a surface when the assembly is rotated by the rotary finishing tool. Known disc assemblies include flap discs, such as disclosed in U.S. Pat. No. 5,752,876, which include a plurality of abrasive flaps adhesively secured about the periphery of a backing disc in an overlapping manner.

Known disc assemblies also include a nut having an internally threaded bore for engaging an externally threaded shaft of a rotary power tool. U.S. Pat. No. 4,541,205 (Patrello) discloses a disc assembly including a disc-shaped abrasive wheel and an internally-threaded nut. A portion of the abrasive wheel adjacent an inner edge of the wheel is covered by ring-like bushings and contained within a notch defined by the nut and an integral retainer that is outwardly rolled over the grinding wheel. The disc assembly of Patrello also includes a reinforcing dish connected to the nut. As shown in FIGS. 1 and 5, the dish extends radially outwardly from the nut to cover a substantial part of the rear surface of the grinding wheel. The added reinforcement provided by the dish functions to distribute applied loads between the nut and the grinding wheel to avoid damage to the inner portion of the grinding wheel.

Other known disc assemblies include separate reinforcing members, such as washers, instead of the above-described integral dish of Patrello, to distribute load between a nut and a disc member of the assembly to avoid damage to an inner radial portion of the disc member.

SUMMARY OF THE INVENTION

The present invention provides a disc assembly for a rotary finishing tool. According to one embodiment, the disc assembly comprises a disc member including an inner radial portion defining a central opening. The disc member preferably comprises a fiber material in a resin matrix. An abrasive material is secured to the outer radial portion of the disc member for finishing a working surface when the disc member is rotated about a central axis of the disc member.

The disc assembly also includes first and second metal reinforcement members each including an annular plate portion located on one of opposite sides of the inner radial portion of the disc member. The disc assembly further includes a nut including an internally threaded body for engagement with a rotary finishing tool. The nut defines a groove in an outer surface in which the first and second reinforcement members are located adjacent the central opening of the disc member. The annular plate portion of each of the reinforcement members extends radially outwardly beyond the outer surface of the receiver and has a sufficient thickness to reinforce the inner radial portion of the disc member without any further reinforcement of the inner radial portion being provided.

According to one embodiment, the disc member further includes an intermediate portion between the inner and outer radial portions. The inner and outer radial portions are substantially perpendicular to the central axis and offset axially from each other.

Preferably, the annular plate portion of each of the first and second reinforcement members has a thickness that is equal to or greater than about 25 percent of a nominal thickness of the disc member. The thickness of the annular plate portion of the first and second reinforcement members might be equal to or greater than about 33 percent of the nominal thickness of the disc member.

According to one embodiment, the disc assembly is a flap disc having a plurality of abrasive flaps secured to an outer radial portion of a backing disc such that a portion of each of the flaps overlaps an adjacent flap.

DESCRIPTION OF THE INVENTION

Figure 1:
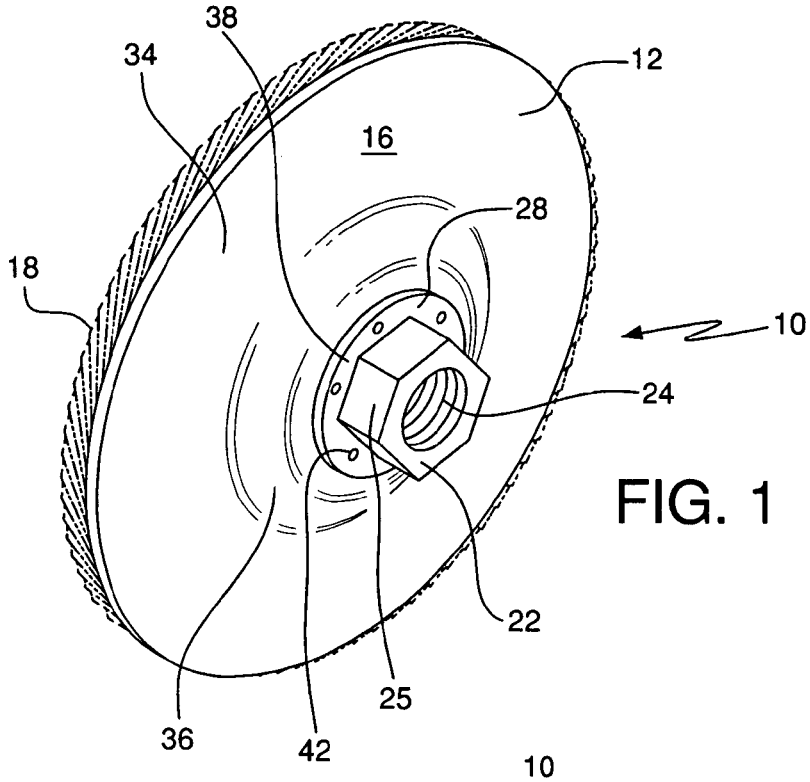
FIG. 1 is a rear perspective view showing a disc assembly for a rotary finishing tool according to the present invention.

Referring to the drawings, where like numerals identify like elements, there is shown a disc assembly 10 according to the invention for a rotary finishing tool (not shown). Rotary finishing tools include a rotatingly driven shaft that engages the disc assembly 10 for rotation of the disc assembly. Rotary finishing tools are well known and, therefore, no further description is required. The disc assembly 10 includes an abrasive material for abrading a working surface using the finishing tool. As will described in greater detail below, the disc assembly 10 provides a construction that is durable and simple, thereby promoting ease of assembly and cost-saving efficiencies.

Figure 2:
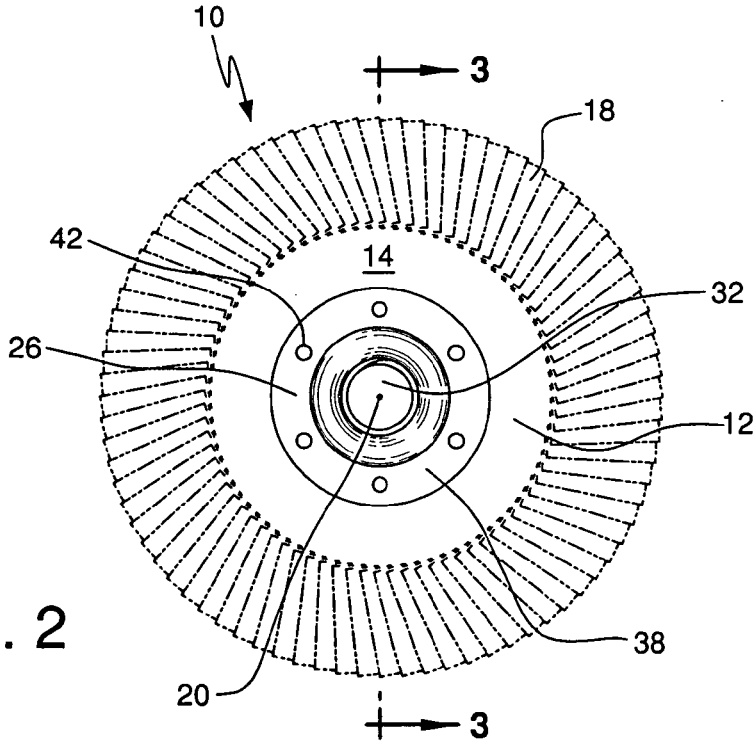
FIG. 2 is a front view of the disc assembly of FIG. 1.

Referring to FIGS. 1 and 2, the disc assembly 10 includes a backing disc 12 having front and rear surfaces 14, 16. The disc assembly 10 includes a plurality of abrasive flaps 18 for contacting a working surface when the disc assembly 10 is rotated about a central axis 20 by a rotary finishing tool. As shown in FIG. 2, the flaps 18 are secured to the front surface 14 of the backing disc 12 and are arranged such that a portion of each of the flaps 18 overlaps a portion of an adjacent flap. The flaps 18 are preferably adhesively secured to the front surface 14 of the backing disc 12. Each of the flaps 18 preferably includes a substrate to which abrasive particles, such as aluminum oxide, are adhesively attached by a resin binder. Discs for rotary finishing tools having flaps arranged in the above-described overlapping manner are known, per se, and are typically referred to as "flap discs". The construction and arrangement of overlapping flaps for a flap disc is described in greater detail in U.S. Pat. No. 5,752,876 (Hettes), which is incorporated herein by reference in its entirety. The application is not limited to the particular arrangement shown and has application to flap discs of various construction. The present invention is also not limited to flap discs and can be applied to disc assemblies in which the abrasive material is presented on the front surface using other configurations, including applications where the disc itself comprises an abrasive material, for example, an abrasive grinding wheel.

The disc assembly includes a nut 22 centrally located with respect to the backing disc 12. As shown in FIG. 1, the nut 22 extends from the rear surface 16 of the backing disc 12 and includes a threaded bore 24 for receiving an externally threaded shaft of a rotary finishing tool to rotate the disc assembly 10 about the central axis 20. The nut 22 includes faceted wrench surfaces 25 formed on an outer surface to facilitate threaded engagement between the nut 22 and the shaft of a rotary finishing tool.

The disc assembly 10 further includes first and second rings 26, 28 located on opposite sides of the backing disc 12. The backing disc 12 preferably comprises a fiber material. A suitable composition for the backing disc 12, as described in U.S. Pat. No. 5,752,876, includes a plurality of fiberglass plies in a resin matrix, although disc 12 may be made of other materials. The reinforcing rings 26, 28 are preferably made from a metal such as low-carbon steel or stainless steel. As described in greater detail below, the rings 26, 28 reinforce the backing disc 12 to facilitate transfer and distribution of loading between the nut 22 and the backing disc 12, thereby avoiding damage to the backing disc 12 that could otherwise result if the backing disc 12 was not reinforced.

Figure 3:
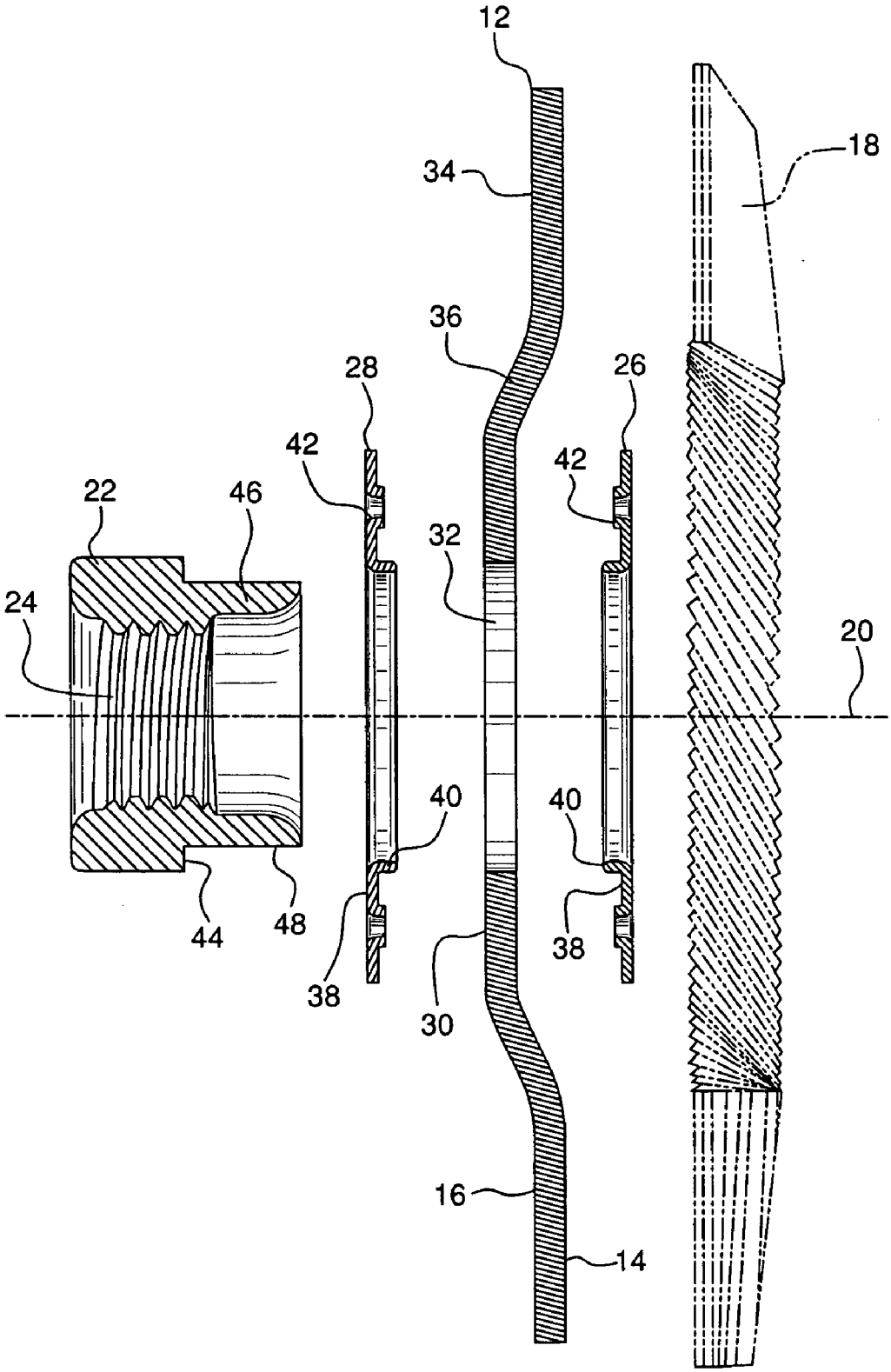
FIG. 3 is an exploded sectional view of the disc assembly of FIGS. 1 and 2 prior to assembly, taken along the lines 3—3 of FIG. 2.
Figure 4:
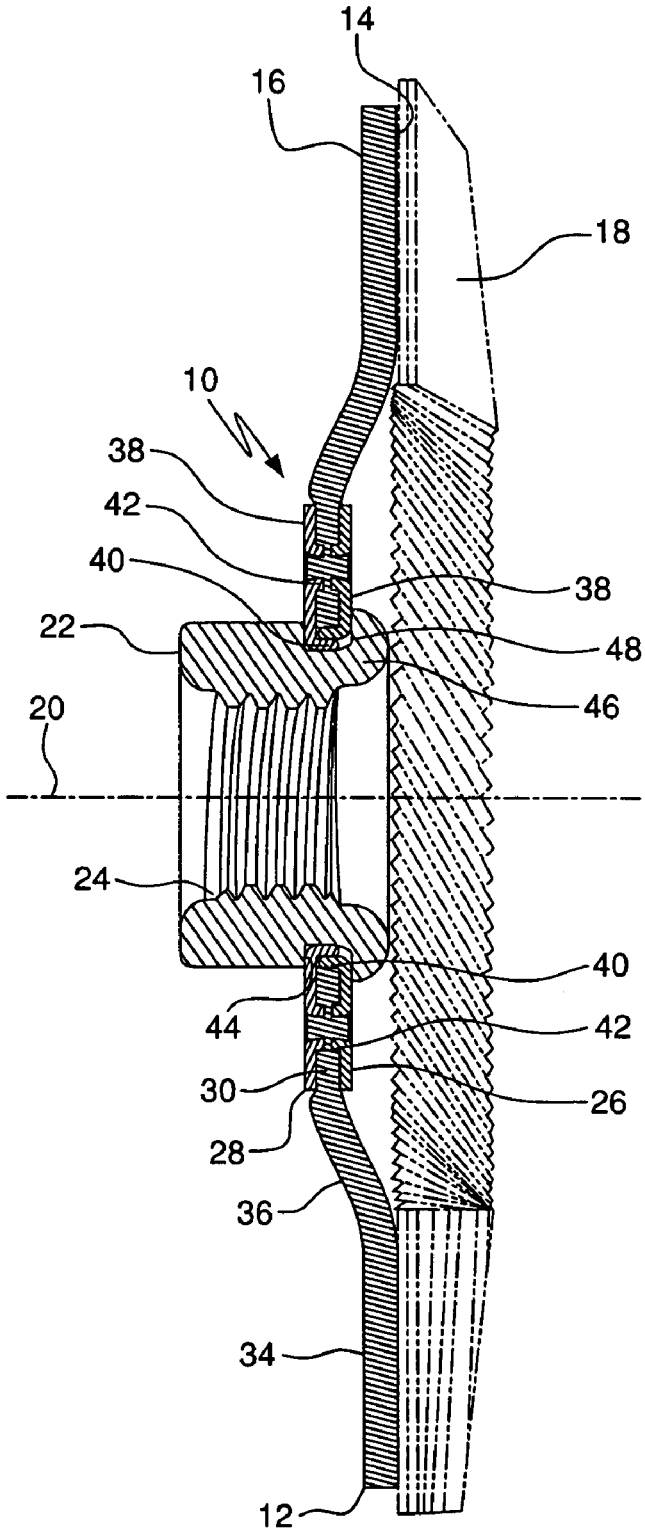
FIG. 4 is a sectional view of the disc assembly of FIGS. 1 and 2, after assembly.

Referring to the sectional views of FIGS. 3 and 4, the construction and arrangement of the elements of the disc assembly 10 of the invention are shown in greater detail. The backing disc 12 includes an inner radial portion 30 defining a central opening 32 and an outer radial portion 34 to which the overlapping abrasive flaps 18 are secured. The backing disc 12 also includes an intermediate portion 36 between the inner and outer radial portions 30, 34. As shown, the intermediate portion 36 is stepped such that the inner and outer radial portions 30, 34 are substantially perpendicular to the central axis 20 and offset axially from each other with respect to the central axis 20. The resulting axial offset between the inner and outer radial portions 30, 34 of the backing disc 12 desirably provides added separation between the nut 22 and the abrasive flaps 18, which extend from opposite sides of the backing disc 12.

Each of the first and second rings 26, 28 includes an annular plate portion 38 that contacts the front and rear surfaces 14, 16, respectively, of the backing disc 12 adjacent the central opening 32 of the inner radial portion 30. As shown, the annular plate portion 38 is preferably dimensioned to extend radially outwardly to cover a significant part of the inner radial portion 30 of the backing disc 12. Each of the first and second rings 26, 28 also includes a flange 40 located at an inner edge of the associated annular plate portion 38 and substantially perpendicular to the annular plate portion 38. As shown in FIG. 4, the flanges 40 of the rings 26, 28 are located within the opening 32 of the backing disc 12 adjacent the inner radial portion 30.

Each of the rings 26, 28 further includes a plurality of pierced portions 42 spaced about the annular plate portion 38 of the rings 26, 28 as shown in FIGS. 1 and 2. The first and second rings 26, 28 are placed onto the front and rear surfaces 14, 16 of the backing disc 12 under pressure such that the pierced portions 42 of the rings 26, 28 are embedded into the backing disc 12. The pressure applied to embed the pierced portions 42 into the backing disc 12 may result in some compression in the thickness of the inner radial portion 30 of the backing disc 12 compared to a nominal thickness for the backing disc 12. Such compression in the thickness of the backing disc 12 may be seen in FIG. 4 by comparing the thickness of the inner radial portion 30 with the thickness of the outer radial portion 34 of the backing disc 12.

The nut 22 includes a radial step in the outer surface of the nut to form a shoulder 44. The nut 22 is received within the central opening 32 of the inner radial portion 30 of backing disc 12 such that the shoulder 44 of nut 22 contacts the annular plate portion 38 of the second ring 28 adjacent the inner edge of the backing disc 12. The disc assembly 10 further includes a retainer 46 portion on the nut 22 that contacts the annular plate portion 38 of the first ring 26. The retainer 46 functions to secure the nut 22 and the first and second rings 26, 28 to the backing disc 12. As shown, the nut 22 and the retainer 46 are preferably integrally formed from the same material.

Referring to FIG. 3, which illustrates the components of the disc assembly 10 prior to their assembly, the retainer 46 on nut 22 defines an outer surface 48 that is substantially cylindrical. The retainer 46 is received in the central opening 32 from the rear of the backing disc 12 such that the shoulder 44 of nut 22 contacts the second ring 28 as described above. The retainer 46 is then rolled outwardly over the inner radial portion 30 of the backing disc 12 such that the outer surface 48 of the retainer 46 is brought into contact with the first ring 26, as shown in FIG. 4. Rolling the retainer 46 creates a groove having opposite side walls defined respectively by the shoulder 44 of nut 22 and the outer surface 48 of the retainer 46 in which the rings 26, 28 and the backing disc 12 are contained.

The annular plate portions 38 of the first and second rings 26, 28 have a thickness that is sufficient to transfer and distribute loads between the nut 22 and the backing disc 12 such that the first and second rings 26, 28 provide all of the reinforcement needed for strengthening the inner radial portion of the backing disc. Preferably, the thickness of the annular plate portion 38 is equal to or greater than approximately ¼ of the nominal thickness of the backing disc 12 and may be equal to at least approximately ⅜ of the nominal disc thickness as seen FIG. 4 by comparing the thickness of the annular plate portion 38 of rings 26, 28 with the thickness of the outer radial portion 34 of the backing disc 12. It should be understood, however, that the relative thickness between the reinforcement rings 26, 28 and the backing disc 12 could vary from than shown depending on the material properties of the rings 26, 28 and the backing disc 12.

The simplified construction of the disc assembly 10 of the present invention eliminates the need for any additional reinforcement for the assembly, such as a washer, for distributing applied loads. The elimination of the need for additional reinforcing members greatly simplifies fabrication and assembly, thereby providing cost-saving efficiencies.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A disc assembly for a rotary finishing tool comprising:

a disc member including an inner radial portion defining a central opening;

an abrasive material secured to an outer radial portion of the disc member for finishing a working surface when the disc member is rotated about a central axis of the disc member;

first and second reinforcement members each including an annular plate portion located on one of opposite sides of the inner radial portion of the disc member; and a nut including internal threads for engagement with a rotary finishing tool, the nut defining a groove in an outer surface in which a portion of each of the first and second reinforcement members is located adjacent the central opening of the disc member;

the annular plate portion of each of the reinforcement members extending radially outwardly beyond the outer surface of the nut and having a sufficient thickness to reinforce the inner radial portion of the disc member without any further reinforcement of the inner radial portion being provided.

2. The disc assembly according to claim 1, wherein the disc member further includes an intermediate portion between the inner and outer radial portions, the inner and outer radial portions being substantially perpendicular to the central axis and offset axially from each other.

3. The disc assembly according to claim 1, wherein the disc member defines a nominal thickness and wherein the annular plate portion of each of the first and second reinforcement members has a thickness that is equal to or greater than about 25 percent of the nominal thickness of the disc member.

4. The disc assembly according to claim 3, wherein the thickness of the annular plate portion of each reinforcement member is equal to or greater than about 33 percent of the nominal thickness of the disc member.

5. The disc assembly according to claim 1, wherein the abrasive material is carried by a plurality of flaps secured to the outer radial portion of the disc member such that each flap overlaps a portion of an adjacent flap.

6. The disc assembly according to claim 5, wherein each of the flaps includes abrasive particles secured to a substrate by a resin binder.

7. The disc assembly according to claim 5, wherein each of the flaps is substantially rectangular.

8. The disc assembly according to claim 1, wherein the nut includes faceted exterior surfaces for engagement with a tool.

9. The disc assembly according to claim 1, wherein the disc member comprises a plurality of fiberglass plies in a resin binder.

10. The disc assembly according to claim 1, wherein each of the first and second reinforcement members includes a flange located at an inner edge of the associated annular plate portion and substantially perpendicular thereto.

11. The disc assembly according to claim 1, wherein the nut includes a body and an end portion connected to the body, the end portion of the nut rolled outwardly such that the groove is defined between the body and the end portion.

12. The disc assembly according to claim 1, wherein the plate portion of each of the reinforcement members includes at least one pierced portion, each of the pierced portions substantially embedded in the inner radial portion of the disc member.

13. A flap disc for a finishing tool having a rotatingly driven drive shaft, the flap disc comprising:

a backing disc comprising a fiber material and having opposite front and rear surfaces defining a nominal thickness therebetween, the backing disc including an inner radial portion defining a central opening for receiving the drive shaft of a finishing tool;

a plurality of abrasive flaps secured to the front surface of the backing disc and located about an outer radial portion of the backing disc, the plurality of abrasive flaps arranged such that a portion of each flap overlaps a portion of an adjacent flap;

first and second metal rings each including a body respectively contacting the front and rear surface of the backing disc adjacent the central opening of the inner radial portion;

a metal nut having internal threads for engagement with a rotary finishing tool for driven rotation of the flap disc about a central axis, the nut defining a radial step in an outer surface of the nut forming a shoulder, the body of the second metal ring contacting the shoulder of the nut adjacent the central opening of the backing disc; and a metal retainer connected to the nut and contacting the body of the first metal ring adjacent the central opening such that the nut and the metal rings are secured to the backing disc;

the body of each of the first and second metal rings having a thickness that is equal to or greater than about 25 percent of the nominal thickness of the backing disc.

14. The flap disc according to claim 13, wherein the body of each of the first and second rings has a thickness that is equal to or greater than about 33 percent of the nominal thickness of the backing disc.

15. The flap disc according to claim 13, wherein the backing disc includes a stepped intermediate portion located between the inner radial portion and the outer radial portion such that the inner and outer radial portions of the backing disc are offset axially from each other with respect to the central axis.

16. The flap disc according to claim 13, wherein the retainer is rolled radially outwardly to contact the first ring.

17. The flap disc according to claim 13, wherein each of the rings includes a flange connected to the associated body and substantially perpendicular thereto.

18. The flap disc according to claim 13, wherein the body of each of the rings includes a plurality of pierced portions, each of the pierced portions being substantially embedded within the inner radial portion of the backing disc.

* * * * *